US008127645B1

(12) United States Patent
Mayfield

(10) Patent No.: US 8,127,645 B1
(45) Date of Patent: Mar. 6, 2012

(54) METHOD AND APPARATUS FOR MACHINING PARTS OF PARTIAL REVOLUTION

(75) Inventor: Calvis L. Mayfield, New Carlisle, IN (US)

(73) Assignee: C M Grinding Incorporated, South Bend, IN (US)

( * ) Notice: Subject to any disclaimer, the term of this patent is extended or adjusted under 35 U.S.C. 154(b) by 360 days.

(21) Appl. No.: 12/575,348

(22) Filed: Oct. 7, 2009

(51) Int. Cl.
*B23C 9/00* (2006.01)
*B23C 5/16* (2006.01)

(52) U.S. Cl. ..... 82/1.11; 82/165

(58) Field of Classification Search ..... 82/1.11, 82/101, 102, 146, 147, 148, 162, 165
See application file for complete search history.

(56) References Cited

U.S. PATENT DOCUMENTS 1,920,209 A 8/1933 Norton
RE22,174 E 9/1942 Groene et al.
2,457,310 A * 12/1948 Judelshon ..... 82/86
3,044,367 A * 7/1962 Thiel ..... 408/37
3,490,336 A * 1/1970 Staub ..... 82/1.3
3,564,706 A * 2/1971 Klingel ..... 29/564
3,630,111 A 12/1971 Hartford et al.
4,282,784 A * 8/1981 Feller et al. ..... 82/19

* cited by examiner

*Primary Examiner* — Will Fridie, Jr.
(74) *Attorney, Agent, or Firm* — Botkin & Hall, LLP

(57) ABSTRACT

A machine and method for machining parts of partial revolution. The machine has a driving sheave rotatable about a first axis and a first driven sheave rotatable about a second axis fixed relative to the first axis. An eccentric link is rotatably connected to the first driven sheave at a pivotal connection that is spaced a predetermined distance from the second axis. A belt is wrapped around the driving sheave and the first driven sheave so that rotation of the driving sheave causes the first driven sheave to rotate. A second driven sheave is rotatable about a third axis fixed relative to the second axis. A second driven sheave contacts with the eccentric link. The eccentric link moves in a reciprocating motion when said first driven sheave is caused to rotate and causes reciprocating rotary motion in the second driven sheave, which is transferred to a part being machined.

10 Claims, 5 Drawing Sheets

METHOD AND APPARATUS FOR MACHINING PARTS OF PARTIAL REVOLUTION

BACKGROUND OF THE INVENTION

Machining parts of revolution is a well established operation that is usually accomplished using a rotating machine such as a lathe or a grinding machine. Doing so will result in a part having a symmetrical cross section when sectioned about the axis of rotation. However, not all parts are symmetrical, yet need to have a portion of their perimeter machined as revolved about an axis while the remainder of the part is a shape that could not be manufactured through simply revolving the part to remove material.

Machining only a portion of the perimeter where it is desired that the perimeter be concentric with an axis of the part would be useful, but would present challenges with regard to controlling dimensions of the part produced. A machine to perform that task would ideally provide for adjustment of the angular portion of the perimeter that would be machined concentric to the axis of rotation. When holding the part it would be useful to provide the capability of adjusting where the concentric portion would begin and end with respect to other features on the perimeter of the part. For production purposes, such a machine and related process would need to be reliably repeatable.

SUMMARY OF THE INVENTION

The present invention is related to a machine for machining parts of partial revolution. The machine has a driving sheave rotatable about a first axis and a first driven sheave rotatable about a second axis fixed relative to the first axis. An eccentric link is rotatably connected to the first driven sheave at a pivotal connection that is spaced a predetermined distance from the second axis. A flexible band is wrapped around a portion of the driving sheave and the first driven sheave so that rotation of the driving sheave causes the first driven sheave to rotate. A second driven sheave is rotatable about a third axis fixed relative to the second axis. A second driven sheave is in contact with the eccentric link. The eccentric link moves in a reciprocating motion when said first driven sheave is caused to rotate and causes reciprocating rotary motion in the second driven sheave. The second driven sheave is adapted to be connected to a part to be machined so that the part rotates with the second driven sheave.

In another aspect of the invention the flexible band may be a belt. In the case where the belt has teeth, the driving sheave and the first driven sheave will also have teeth that interact with the teeth on the belt to prevent slippage.

In another aspect of the invention, the second driven sheave is a gear having teeth and the rack has teeth for interfacing with the gear.

In yet another aspect of the invention, the pivotal connection is connected to a slide plate and the slide plate is selectively slidable relative to the first driven sheave. The space between the pivotal connection and the axis of the first driven sheave may be changed by moving the slide plate.

DETAILED DESCRIPTION OF INVENTION

Figure 1:
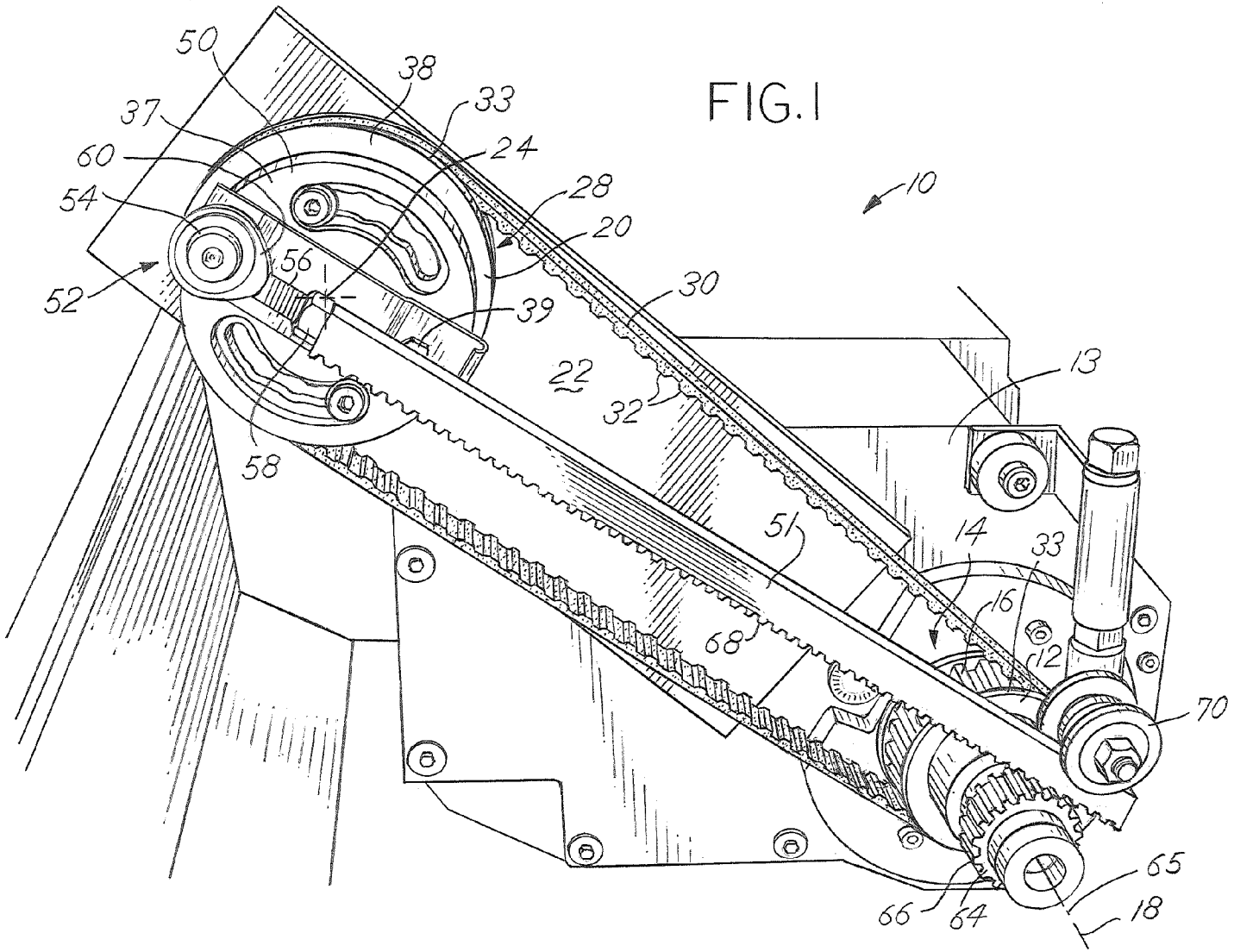
FIG. 1 is a perspective view of the machine of the invention.

The machine 10 of this invention is shown in FIG. 1 and is a modified version of a typical grinding machine. The motor of the machine 10 rotates a driving sheave 12 that extends from the face 13 of the machine 10. The driving sheave 12 has an outer surface 14 with teeth 16. The driving sheave 12 rotates about a first axis 18, which corresponds to its centerline.

A first driven sheave 20 is mounted to a mounting plate 22 that extends from the face 13 of the machine 10. The first driven sheave 20 rotates about a second axis 24 that is fixed with respect to the first axis 18 of the driving sheave 12. The first driven sheave 20 also has teeth 26 around its outer surface 28. A belt 30 is wrapped around a portion of each of the outer surfaces 14, 28 of the driving sheave 12 and the first driven sheave 20 so that when the driving sheave 12 rotates, the first driven sheave 20 also rotates. The belt 30 has teeth 32 that engage with the teeth 16, 26 on the driving sheave 12 and the first driven sheave 20 so that no slippages occur between the belt 30 and sheaves 12, 20. Thus, the same proportional rotational relationship is maintained between the sheaves 12, 20 at all times. The driving sheave 12 and driven sheave 20 each have collars 33 near their ends. The collars 33 maintain the belt in a centered position on the sheaves 12, 20.

The first driven sheave 20 has an adjustable cylinder portion 37 that is mounted on a front lateral surface 38 of the first driven sheave 20. The cylinder 37 rotates with the first driven sheave 20 about the second axis 24. The cylinder portion 37 is selectively rotatable relative to the first driven sheave 20. Set screws 40 within slots 41 in the cylinder portion 37 are driven into the sheave 20 and when loosened, the cylinder portion 37 may be rotated relative to the sheave 20. When the sheave 20 is moved into a desired position, the set screws 40 are tightened to lock the cylinder portion 37 relative to the first driven sheave 20. A slide plate 46 is connected to a front face 50 of the cylinder portion 37 and selectively slidable relative to the first driven sheave 20. The slide plate is attached to the cylinder portion 37 with bolts 39 in T-slots, which is a connection well known in the art of production machinery. FIG. 1 shows one of the bolts 39 holding the slide plate 46 in place. When the slide plate 46 is in the desired position, the bolts 39 are tightened to lock the slide plate 46 from sliding relative to the first driven sheave 20.

Figure 2:
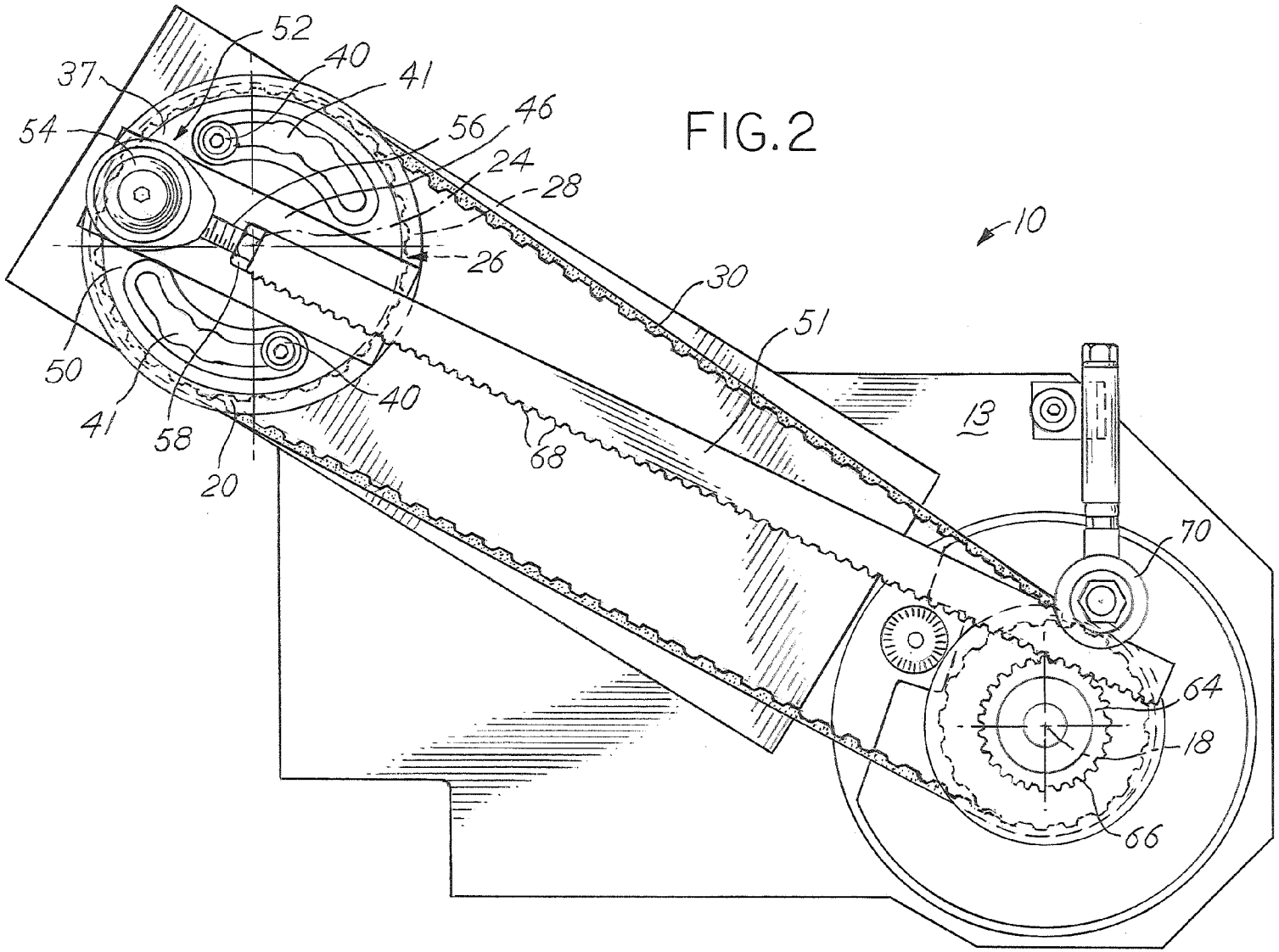
FIG. 2 is a front view of the machine shown in FIG. 1.
Figure 3:
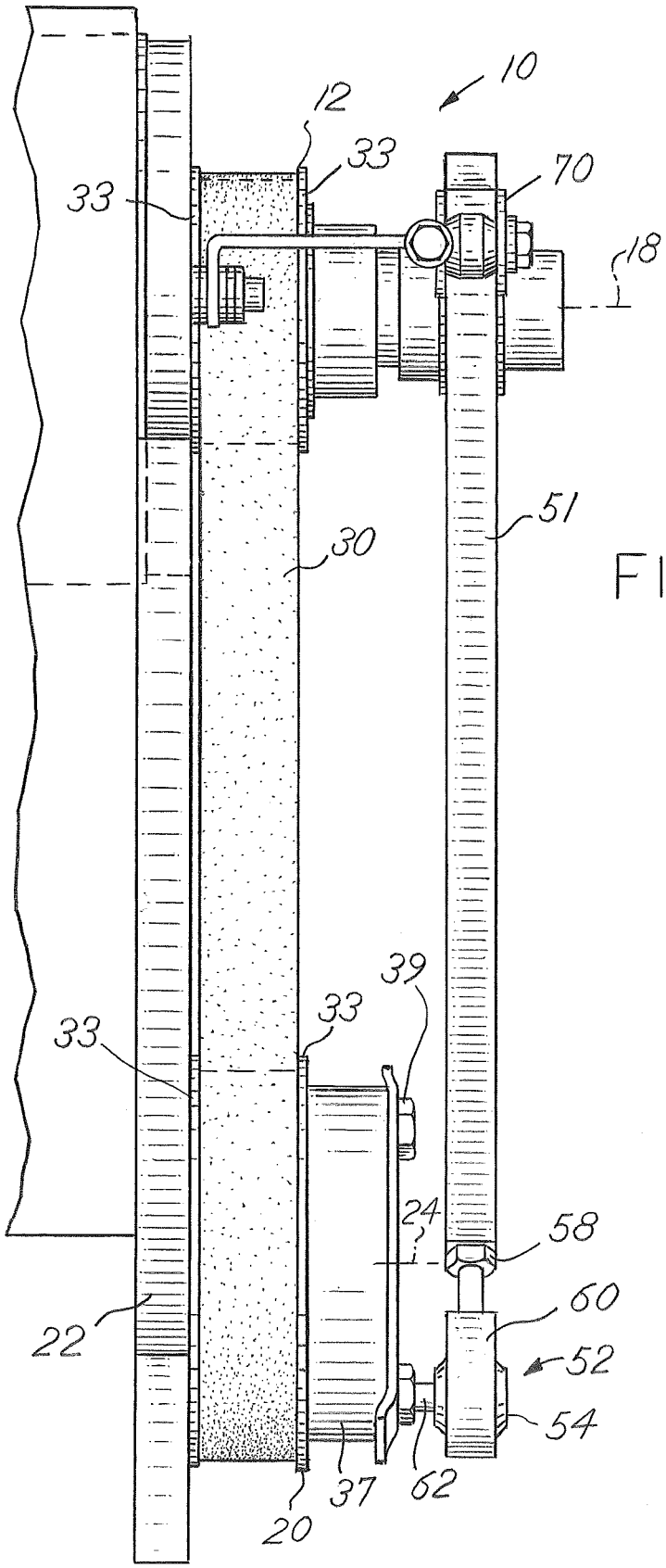
FIG. 3 is a top view of the machine shown in FIG. 1.
Figure 4:
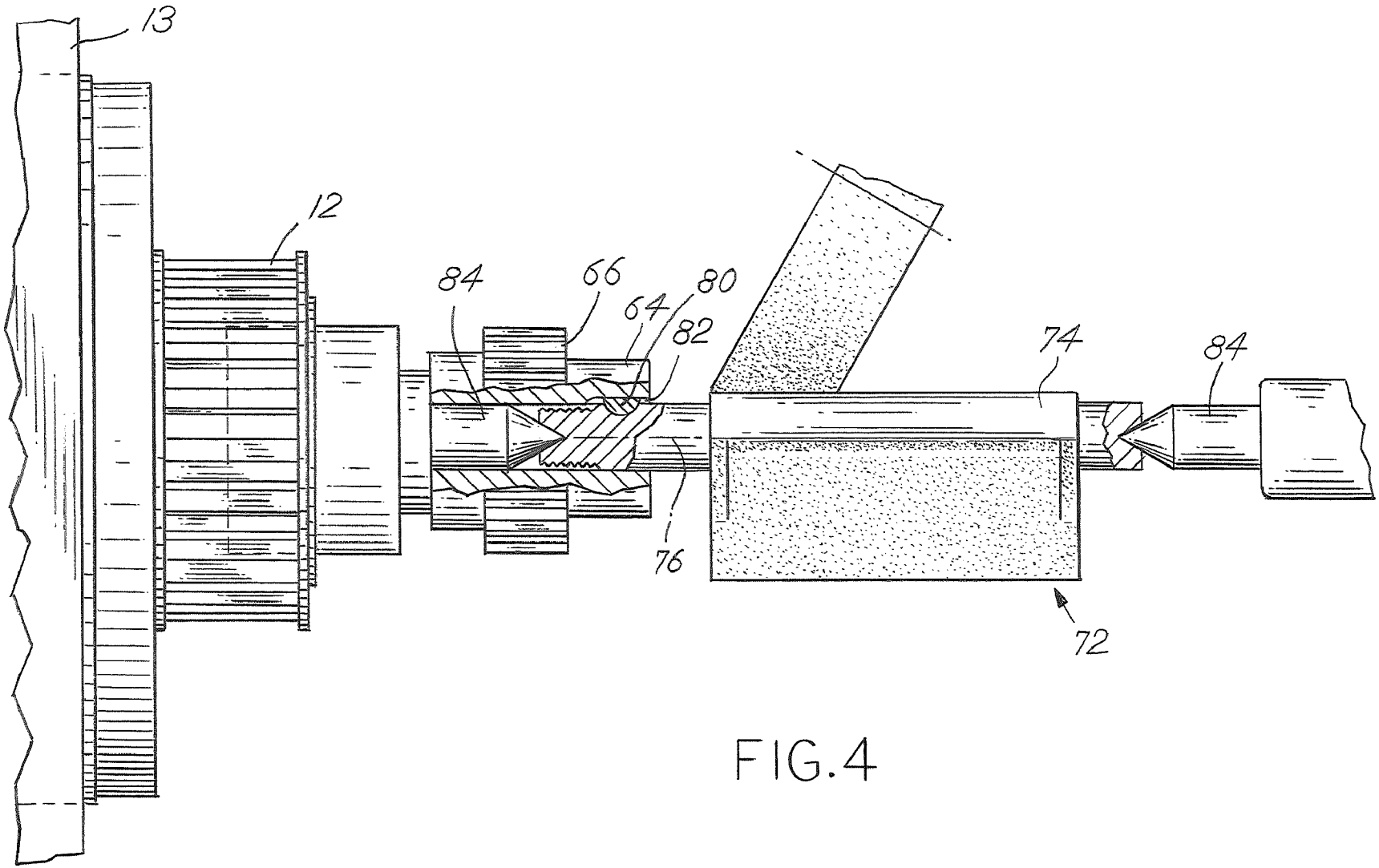
FIG. 4 is a top view of the machine shown in FIG. 1 also showing the part being machined and the grinding wheel machining the concentric portion of the part.

An eccentric link, which in this case is a rack 51, is pivotally connected to the slide plate 46 with a ball joint 52 driven into the slide plate 46. The ball joint 52 has a ball end 54 and a threaded end 56. The centerline of the threaded end shall be referred to as the axis of the ball joint 52 hereinafter. The ball end 54 of the ball joint 52 is spaced a predetermined distance from the second axis 24, which corresponds to the center of the first driven sheave 20. The amount of eccentricity or space from the second axis 24 may be changed by locking the slide plate 46 to a different position. The threaded end 56 of the ball joint 52 is threaded into the rack 51 and a jamb nut 58 is also located on the threaded end 56. When the jamb nut 58 is tightened against the rack as shown in FIGS. 1 and 2, the ball joint 52 is rigidly connected to the rack 51 and cannot rotate about its axis relative to the rack 51. When the jamb nut 58 is backed away from the rack 51, the ball joint 52 may be rotated about the axis of the threaded end 56. When the ball joint is turned clockwise as viewed from the ball joint 52 looking toward the rack, the rack 51 will be brought closer to the ball end 54. Rotating the ball joint 52 the opposite direction will move the rack farther from the ball end 54. The ball joint may be rotated until the casing 60 of the ball joint 52 rests on the post 62.

The rack 51 extends onto and contacts a second driven sheave which is a gear 64 having teeth 66 that engage teeth 68 on the rack 51. The use of a gear 64, as opposed to a smooth sheave, prevents slippage between the rack 51 and the gear 64. The gear 64 is adjacent to the driving sheave 12 and rotates about a third axis 65 that is coaxial with the first axis 18 of the driving sheave. The gear 64 and driving sheave 12 rotate separately. An idler pulley 70 mounted to the front face 13 of the machine holds the rack into engagement with the gear 64.

Figure 5:
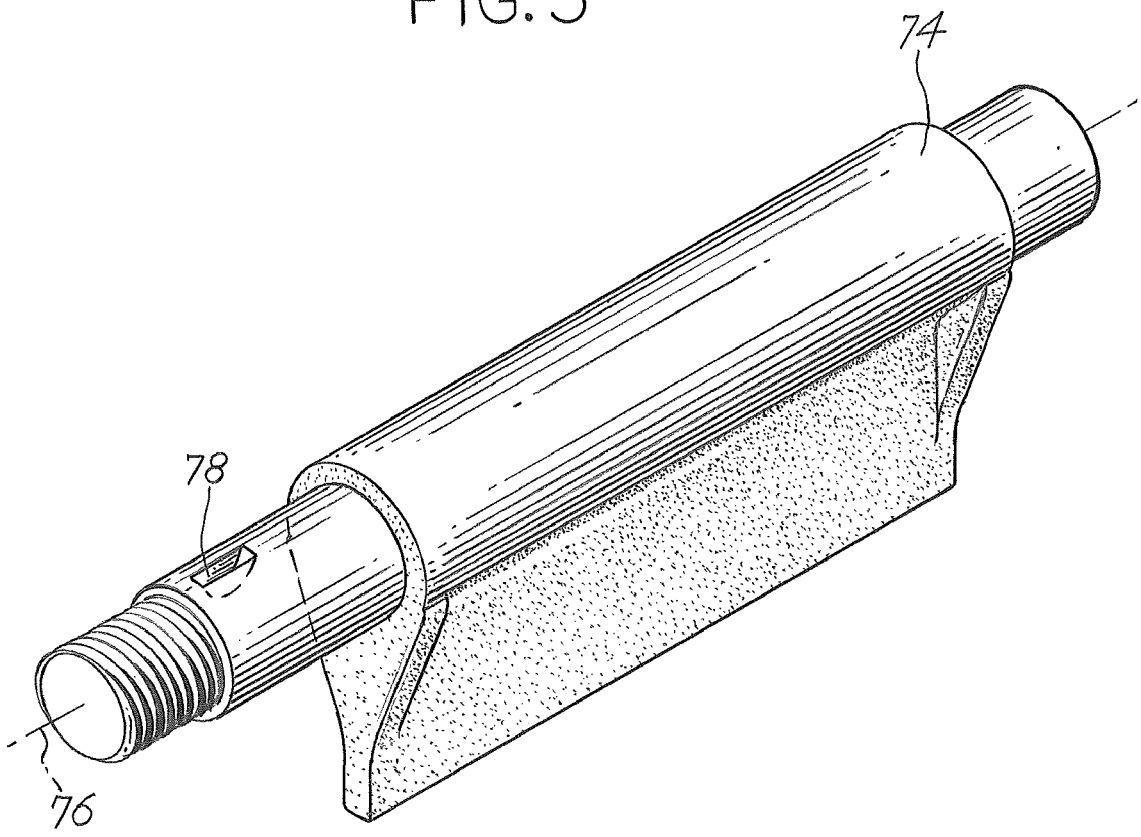
FIG. 5 is a perspective view of the part shown in FIG. 4.

The gear 64 is adapted to be connected to a part 72. FIG. 5 shows an example part 72 that has a portion 74 that is concentric with an axis 76 of the part 72 and is formed by revolving the part 72 about its axis 76. The concentric portion 74 is typical of a part that would be machined on the device of this invention. The gear 64 is adapted to receive the part 72 so that the part 72 rotates with the gear 64. The part 72 has a keyway 78 that receives a key 80. The key 80 is also received in a keyway 82 in the gear, thus the gear 64 and the part 72 rotate together. The part 72 is held between live centers 84 so that it is rotatable about its axis 76 when the gear 64 rotates. The axis of the part 76 is coaxial with the third axis 65.

When the motor within the machine 10 rotates the driving sheave 12, the belt 30 will rotate the first driven sheave 20. As the first driven sheave 20 rotates, this will cause reciprocating motion of the rack 51 as it pivots about the center of the ball end 54 of the ball joint 52. The space between the second axis 24 and the center of the ball end 54 will determine the stroke length of the reciprocating motion. The reciprocating motion of the rack 51 will be transmitted to the gear 64 and the part 72. Both the gear 64 and the part 72 will exhibit the same reciprocating rotary motion. The reciprocating rotary motion will correspond to a particular angle. Thus, the angle of reciprocating motion of the part 72 may be adjusted by moving the slide plate 46. Therefore, the closer the center of the ball end 54 is to the second axis 24, the smaller the angle the part 72 will reciprocate through.

As the part 72 rotates, a grinding wheel will traverse longitudinally along the machined concentric portion 74 to produce the concentric portion 74. The desired angle of the concentric portion 74 that is machined may be adjusted by moving the slide plate 46 as described above. The farther the center of the ball end 54 is away from the second axis 24, the larger the angle that will be machined into the concentric portion 74. In the example part 72 shown, the concentric portion 74 is centered with respect to the keyway 78 of the part. In other words, the center of reciprocating rotary motion corresponds with the center of the concentric portion 74.

In some instances it might be desirable to skew the machined concentric portion 74 with respect to the keyway 78. Such an adjustment is made by loosening the set screws 40 in the cylinder portion 37 and rotating the cylinder portion relative to the first driven sheave 20. The set screws 40 may then be tightened down and the center of reciprocation will be centered about a different line on the part 72. This may be desirable if the keyway 78 of the part 72 is located in a different area of the part with respect to where the concentric portion is to be located. Moving the center of reciprocation may also be desirable when machining different types of parts. It should be noted that the angle of rotational reciprocation will not be affected by moving the cylinder portion 37 as described above.

Another way to adjust the center of reciprocation is to rotate the ball joint 52 about its axis. To do so, the jamb nut 58 is loosened, the rack 51 is lifted in order to disengage with the gear 64, and the rack 51 is rotated one turn in the desired direction. This will provide fine adjustment for the center of reciprocation and may be done as a way of fine tuning the adjustments made by adjusting the cylinder portion 37 as described above. A finer adjustment is described above by rotating the ball joint 52 in either direction until the casing 60 of the ball joint 52 rests on the post 62. Rotating the ball joint 52 will adjust the gear 64 by less than one tooth.

The invention is not limited to the description above, but may be modified within the scope of the following claims.

What is claimed is:

1. A machine for machining parts of partial revolution comprising:

a driving sheave rotatable about a first axis;

a first driven sheave rotatable about a second axis fixed relative to said first axis;

an eccentric link rotatably connected to said first driven sheave at a pivotal connection being spaced a predetermined distance from said second axis;

a flexible band in contact with and wrapped around a portion of said driving sheave and said first driven sheave so that rotation of said driving sheave causes said first driven sheave to rotate; and a second driven sheave rotatable about a third axis fixed relative to said second axis, said second driven sheave in contact with said eccentric link, said eccentric link moving in a reciprocating motion when said first driven sheave is caused to rotate, said eccentric link causing reciprocating rotational movement in said second driven sheave when said first driven sheave is rotated, said second sheave adapted for connecting to a part to be machined so that said part rotates with said second driven sheave.

2. A machine as claimed in claim 1, wherein said flexible band is a belt.

3. A machine as claimed in claim 2, wherein said driving sheave has an outer surface including teeth, and said first driven sheave has an outer surface including said teeth and said belt has teeth for meshing with said teeth on said driving sheave and said first driven sheave.

4. A machine as claimed in claim 3, wherein said eccentric link is a rack having teeth, and said second driven sheave is a gear having teeth for interfacing with said teeth on said rack.

5. A machine as claimed in claim 4, wherein said space between said pivotal connection and said second axis may be adjusted.

6. A machine as claimed in claim 5, wherein said gear and said driving sheave are coaxial.

7. A machine as claimed in claim 5, wherein pivotal connection is connected to a slide plate, said slide plate is selectively slidable relative to said first driven sheave, and said space between said pivotal connection and said second axis may be changed by moving said slide plate.

8. A machine as claimed in claim 7, wherein said first driven sheave includes an adjustable cylinder portion releasably mounted to a lateral surface, said cylinder portion selectively rotatable relative to said first driven sheave, said slide plate being connected to said cylinder portion.

9. A machine as claimed in claim 7, wherein said pivotal connection is a ball joint having a ball end and a threaded end, said threaded end having a jamb nut thereon and said threaded end threaded into said rack so that rotation of said ball joint about the axis of the threaded portion will move said rack relative to said ball end.

10. A method for machining a part of partial revolution including the steps of:

providing a driving sheave that is rotated about a first axis;

providing a driven sheave that is rotatable about a second axis that is fixed relative to said first axis;

connecting an eccentric link to said first driven sheave at a pivotal connection spaced a predetermined distance from said second axis;

wrapping a flexible band around a portion of said driving sheave and said first driven sheave so that rotation of said driving sheave causes said first driven sheave to rotate; and connecting said eccentric link to a gear that is rotatable about a third axis fixed relative to said second axis, said eccentric link moving in a reciprocating motion when said first driven sheave is caused to rotate causing reciprocating rotational movement in said gear, said gear adapted for connecting to a part to be machined so that said part rotates with said gear.

* * * * *